US010639697B2

(12) United States Patent
Yabuoshi

(10) Patent No.: US 10,639,697 B2
(45) Date of Patent: May 5, 2020

(54) METHOD OF MANUFACTURING PIPE ASSEMBLY

(71) Applicant: TOYOTA JIDOSHA KABUSHIKI KAISHA, Toyota-shi, Aichi-ken (JP)

(72) Inventor: Masahito Yabuoshi, Chiryu (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 9 days.

(21) Appl. No.: 16/037,386

(22) Filed: Jul. 17, 2018

(65) Prior Publication Data

US 2019/0022731 A1 Jan. 24, 2019

(30) Foreign Application Priority Data

Jul. 24, 2017 (JP) ..... 2017-142588
May 15, 2018 (JP) ..... 2018-093613

(51) Int. Cl.
*B21D 26/14* (2006.01)
*B21D 39/04* (2006.01)

(52) U.S. Cl.
CPC ..... *B21D 26/14* (2013.01); *B21D 39/04* (2013.01); *Y10T 29/4994* (2015.01); *Y10T 29/49803* (2015.01); *Y10T 29/49911* (2015.01)

(58) Field of Classification Search
CPC ... B21D 26/14; B21D 39/04; Y10T 29/49911; Y10T 29/49803; Y10T 29/4994
See application file for complete search history.

(56) References Cited

U.S. PATENT DOCUMENTS 5,195,239 A * 3/1993 Breuer ..... B21D 26/14 29/468
2003/0218333 A1* 11/2003 Barber ..... F28F 9/16 285/124.1
2017/0349218 A1 12/2017 Nishimura et al.

FOREIGN PATENT DOCUMENTS

JP 2016-120866 A 7/2016

* cited by examiner

*Primary Examiner* — Jermie E Cozart
(74) *Attorney, Agent, or Firm* — Oliff PLC

(57) ABSTRACT

A plurality of additional fixture members placed outside a pipe member at a plurality of positions of the pipe member, where the plurality of fixture members are fixed, and a plurality of electromagnetic coils placed inside the pipe member at the plurality of positions of the fixed pipe member. In this state, a pulse current is applied to the plurality of electromagnetic coils located at a first joint, where the fixture member is joined to the outside of the portion where first and second pipe elements of the pipe member are fitted to each other, is swaged and fixed to the pipe member before an fixture member located at a second joint, wherein fixture member is joined to at least one of the first and second pipe elements at a different position, so the plurality of fixture members are swaged and fixed to the pipe member by electromagnetic forming.

3 Claims, 6 Drawing Sheets

METHOD OF MANUFACTURING PIPE ASSEMBLY

CROSS REFERENCE TO RELATED APPLICATIONS

The entire disclosure of Japanese Patent Applications Nos. 2017-142588 filed on Jul. 24, 2017, and 2018-093613 filed on May 15, 2018, including the specification, claims, drawings, and abstract, is incorporated herein by reference in its entirety.

TECHNICAL FIELD

The present disclosure relates to a method of manufacturing a pipe assembly including a pipe member and a plurality of additional fixture members that are externally fixed to the pipe member.

BACKGROUND

JP 2016-120866 A discloses fixing a steering column support member, a floor brace, and other members serving as the plurality of additional fixture members, at a plurality of positions of the pipe by bolting or welding.

The plurality of additional fixture members may be externally fixed to the pipe member by simultaneous electromagnetic forming. In simultaneous electromagnetic forming, the plurality of additional fixture members are placed outside the pipe member at a plurality of positions as viewed in the axial direction in a state in which they are fitted to each other, and electromagnetic coils are placed inside the pipe member at the positions where the additional fixture members are to be fixed. A pulse current is then simultaneously applied to the electromagnetic coils so that the plurality of additional fixture members are externally fixed to the pipe member. As such, the manufacturing time of the pipe assembly including the pipe member and the plurality of additional fixture members may be shortened.

However, while a current is intended to be simultaneously applied to the plurality of electromagnetic coils in order to simultaneously fix the plurality of additional fixture members by swaging the pipe member by electromagnetic forming, a slight time lag may occur in an actual process between times at which a current is applied to a plurality of portions that are to be swaged. As such, the resulting order in which a current is applied may cause a failure to form the pipe assembly into a desired shape.

The method of manufacturing a pipe assembly according to the present disclosure is directed toward manufacturing a pipe assembly having a desired shape while shortening the manufacturing time of the pipe assembly.

SUMMARY

According to an aspect of the present disclosure, there is provided a method of manufacturing a pipe assembly, the pipe assembly including a pipe member and a plurality of additional fixture members that are externally fixed to the pipe member. In this method, the pipe member includes a first pipe element and a second pipe element that is fitted and joined to an end portion of the first pipe element. A plurality of joints between the pipe member and the plurality of additional fixture members at a plurality of positions of the pipe member, as viewed in the axial direction, where the plurality of additional fixture members are to be fixed include a first joint, where one of the additional fixture members is joined to the outside of the portion where the first pipe element and the second pipe element are fitted to each other, and one or more second joints, where one or more of the additional fixture members are joined to at least one of the first pipe element and the second pipe element at one or more positions other than where the first pipe element and the second pipe element are fitted to each other. The method comprises placing the plurality of additional fixture members outside the pipe member at the plurality of positions where the plurality of additional fixture members are to be fixed; placing a plurality of electromagnetic coils inside the pipe member at one or more of the plurality of positions where the plurality of additional fixture members are to be fixed; and while the pipe member, the plurality of additional fixture members, and the plurality of electromagnetic coils are in this state, increasing the diameter of the pipe member in areas corresponding to where the plurality of electromagnetic coils are placed as viewed in the axial direction by applying a pulse current to the plurality of electromagnetic coils, so that the plurality of additional fixture members are swaged and fixed to the pipe member by electromagnetic forming. The additional fixture member that constitutes the first joint is swaged and fixed to the pipe member by electromagnetic forming before the additional fixture members that constitute the second joints.

By employing the above-described method of manufacturing a pipe assembly according to the present disclosure, the diameter of the pipe member is increased at a plurality of positions of the pipe member by applying a current to the plurality of electromagnetic coils while the plurality of electromagnetic coils are placed inside the pipe member, so that the plurality of additional fixture members are swaged and fixed to the pipe member. The manufacturing time of the pipe assembly can therefore be shortened. The portion of the pipe member that forms the first joint is worked on before the portions of the pipe member that form the second joints. The assembly accuracy of the first joint is therefore easily maintained at a high level. While, at the first joint, two pipe elements, namely the first and second pipe elements, are to be deformed by electromagnetic forming, at the second joints, both the two pipe elements do not have to be deformed. Therefore, the required assembly accuracy tends to be higher at the first joint than at the second joints. As such, even if deformation of the portions of the pipe member that form the second joints is caused by deformation of the portion of the pipe member that forms the first joint, the impaired deformation accuracy is easily absorbed at the second joints. Therefore, the pipe assembly can be manufactured into a desired shape while the manufacturing time of the pipe assembly is shortened.

In the method of manufacturing a pipe assembly according to the present disclosure, preferably, the first pipe element may be a pipe element to which three or more of the plurality of additional fixture members are to be externally fixed. Two end side additional fixture members that are placed at positions each closest to one of two ends of the first pipe element and one or more intermediate additional fixture members that are placed between the two end side additional fixture members may be swaged and fixed to the first pipe element by electromagnetic forming as the three or more of the plurality of additional fixture members. While the three or more of the plurality of additional fixture members are fixed to jigs in a manner such that they are fitted to the first pipe element with a clearance between them, one of the two end side additional fixture members that is fixed to the first pipe element later than the other, may be swaged and fixed to the first pipe element by electromagnetic forming either after or simultaneously with the one or more intermediate additional fixture members.

In this preferred structure, the shape accuracy of the pipe assembly is easily further enhanced. Specifically, one of the two end side additional fixture members that is fixed to the first pipe element later than the other, is swaged and fixed to the first pipe element by electromagnetic forming either after or simultaneously with the one or more intermediate additional fixture members. Therefore, because at least one end portion of the first pipe element is not fixed to any jig when the intermediate additional fixture members are swaged and fixed to the first pipe element, deformation of the first pipe element in the axial direction is allowed so as to relieve stress produced in the first pipe element by swaging. As such, it is possible to prevent deformation of the first pipe element in the axial direction from occurring in a state in which the two end side additional fixture members are fixed to the first pipe element when the additional fixture members are later removed from the jigs, and the length of the first pipe element between the two end side additional fixture members is easily adjusted to a desired value. Therefore, the shape accuracy of the pipe assembly is easily enhanced.

According to another aspect of the present disclosure, there is provided a method of manufacturing a pipe assembly, the pipe assembly including a pipe member and a plurality of additional fixture members that are externally fixed to the pipe member. In this method, the pipe member includes at least one pipe element to which three or more of the plurality of additional fixture members are to be externally fixed. Two end side additional fixture members that are placed at positions each closest to one of two ends of the pipe element and one or more intermediate additional fixture members that are placed between the two end side additional fixture members are swaged and fixed to the pipe element by electromagnetic forming as the three or more of the plurality of additional fixture members. The method comprises placing the three or more of the plurality of additional fixture members outside the pipe element at a plurality of positions of the pipe member, as viewed in the axial direction where the three or more of the plurality of additional fixture members are to be fixed; placing a plurality of electromagnetic coils inside the pipe element at one or more of the plurality of positions where the three or more of the plurality of additional fixture members are to be fixed; and while the three or more of the plurality of additional fixture members are fixed to jigs in a manner such that they are fitted to the pipe element with a clearance between them, increasing the diameter of the pipe member in areas corresponding to where the plurality of electromagnetic coils are placed, as viewed in the axial direction, by applying a pulse current to the plurality of electromagnetic coils, so that the three or more of the plurality of additional fixture members are swaged and fixed to the pipe member by electromagnetic forming. One of the two end side additional fixture members that is fixed to the pipe element later than the other, is swaged and fixed to the pipe element by electromagnetic forming either after or simultaneously with the one or more intermediate additional fixture members.

By employing the above-described method of manufacturing a pipe assembly according to the present disclosure, the diameter of the pipe member is increased at a plurality of positions of the pipe member by applying a current to the plurality of electromagnetic coils while the plurality of electromagnetic coils are placed inside the pipe member, so that the plurality of additional fixture members are swaged and fixed to the pipe member. The manufacturing time of the pipe assembly can therefore be shortened. One of the two end side additional fixture members that is fixed to the pipe element later than the other, is swaged and fixed to the pipe element by electromagnetic forming either after or simultaneously with the one or more intermediate additional fixture members. Therefore, because at least one end portion of the pipe element is not fixed to any jig when the intermediate additional fixture members are swaged and fixed to the pipe element, deformation of the pipe element in the axial direction is allowed so as to relieve stress produced in the pipe element by swaging. As such, because it is possible to prevent deformation of the pipe element in the axial direction from occurring in a state in which the two end side additional fixture members are fixed to the pipe element when the additional fixture members are later removed from the jigs, and because the length of the pipe element between the two end side additional fixture members is easily adjusted to a desired value, the shape accuracy of the pipe assembly is easily enhanced. Therefore, the pipe assembly can be manufactured into a desired shape while the manufacturing time of the pipe assembly is shortened. In contrast, the intermediate additional fixture members may be swaged and fixed to the pipe element by electromagnetic forming after one of the two end side additional fixture members that is fixed to the pipe element later than the other. In this case, after the two end side additional fixture members are both swaged and fixed to the pipe element, as the pipe element is in a state in which the end portions on both sides of the pipe element are fixed to the jigs via the end side additional fixture members, stress produced when the intermediate additional fixture members are later swaged and fixed to the pipe element cannot be relieved. As such, the pipe element may deform to shrink so as to relieve that stress when the additional fixture members are removed from the jigs, such that the length between the two end side additional fixture members becomes shorter. By employing the above-described method of manufacturing a pipe assembly according to the present disclosure, this issue can be addressed, and the shape accuracy of the pipe assembly is easily enhanced.

In the method of manufacturing a pipe assembly according to the present disclosure, the pipe assembly can be manufactured into a desired shape while the manufacturing time of the pipe assembly is shortened.

BRIEF DESCRIPTION OF DRAWINGS

Embodiments of the present disclosure will be described based on the following figures, wherein.

DESCRIPTION OF EMBODIMENTS

Figure 1:
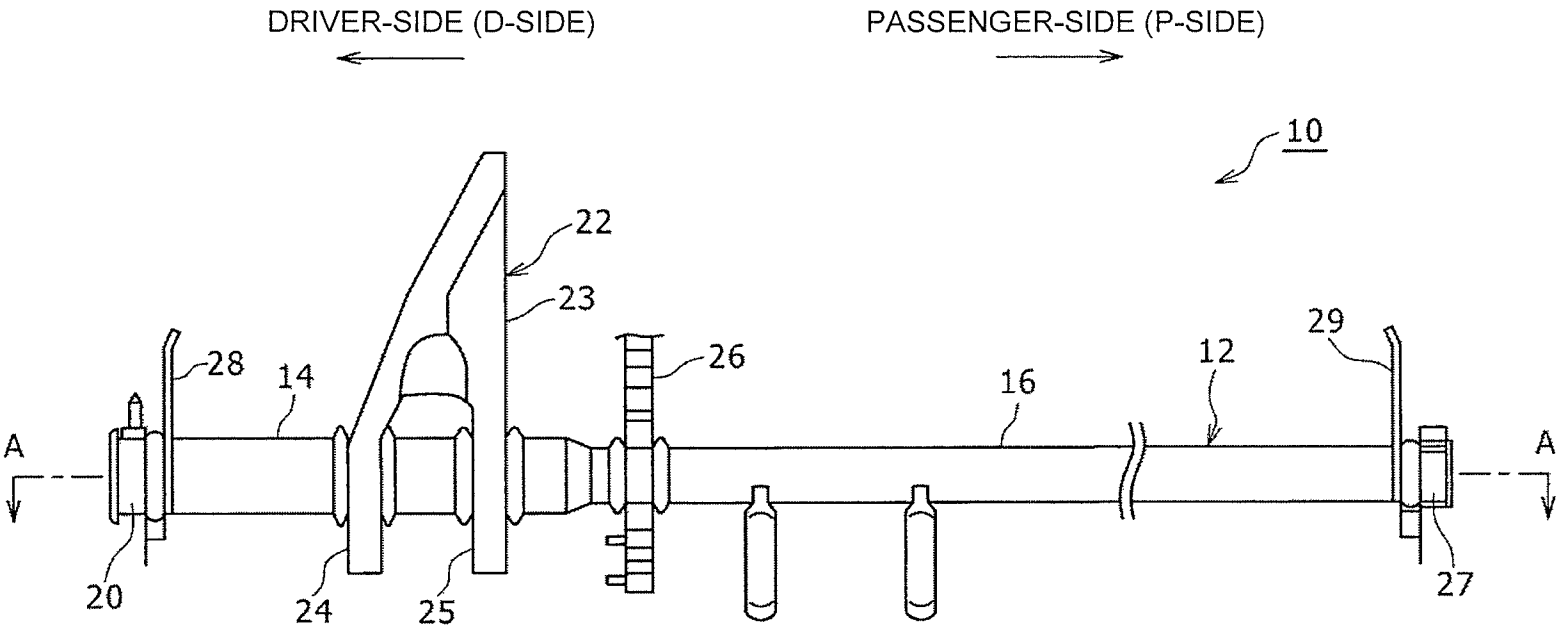
FIG. 1 illustrates a pipe assembly manufactured by a method of manufacturing a pipe assembly according to an embodiment of the present disclosure.

Embodiments of the present disclosure will be described below with reference to the accompanying drawings. Specific shapes, materials, and counts specified herein are given by way of example and may be changed as appropriate to suit the specifications of the pipe assembly. As an example of the pipe member included in the pipe assembly, an instrument panel reinforcement placed in an instrument panel of a vehicle will be described below. However, the pipe member is not limited to this example, and the present disclosure may be applied to various types of structures. In the following disclosure and throughout the drawings, like elements are denoted by the same reference numerals. Reference numerals used earlier in this disclosure will be used in later description where appropriate.

FIG. 1 illustrates a pipe assembly 10 manufactured by a method of manufacturing a pipe assembly according to an embodiment. While the method of manufacturing the pipe assembly 10 will be described later, the structure of the pipe assembly 10 will first be described.

The pipe assembly 10 includes a pipe member 12 and a plurality of additional fixture members that are externally fixed to the pipe member 12. The pipe member 12 is an instrument panel reinforcement. The instrument panel reinforcement is placed in an instrument panel of a vehicle to lie in the width direction of the vehicle. The instrument panel is attached to the instrument panel reinforcement.

Referring to FIG. 1, a driver-side extension 20, a steering support 22, a cowl brace 26, a passenger-side extension 27, and two outer brackets 28 and 29 serving as the plurality of additional fixture members are fixed to the pipe member 12. In some portions of the following disclosure, the driver-side is referred to as "D-side", and the passenger-side is referred to as "P-side". The plurality of additional fixture members are fixed to the outside of the pipe member 12 by electromagnetic forming using an electromagnetic coil placed inside the pipe member 12.

The pipe member 12 is formed in a long tubular shape using an electrically conductive metal such as an aluminum alloy. As such, electromagnetic forming is easily performed as the pipe member 12 is deformed when a current is applied to an electromagnetic coil that is placed inside the pipe member 12, as will be described later.

Figure 2:
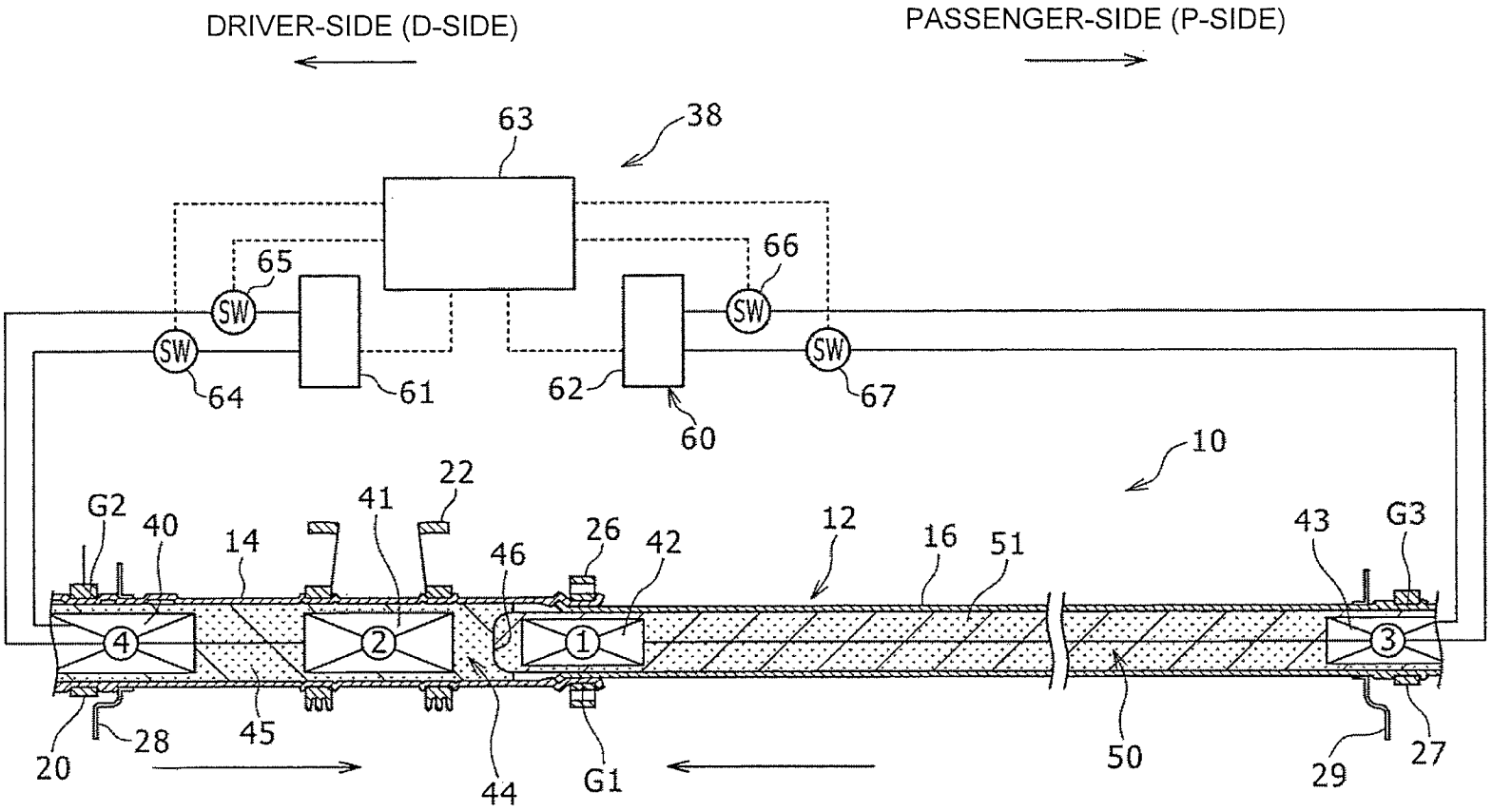
FIG. 2 is a cross section A-A in FIG. 1 that illustrates the method of manufacturing a pipe assembly according to the embodiment of the present disclosure.

The pipe member 12 includes a D-side pipe element 14 having a long cylindrical shape that is placed on a first end side (left side in FIG. 1), which is the driver side ("D-side"), and a P-side pipe element 16 having a long cylindrical shape that is fitted and joined to a second end portion (right end portion in FIG. 1) of the D-side pipe element 14 and that is placed such that it extends toward the second side as viewed in the axial direction. The D-side pipe element 14 corresponds to the first pipe element, and the P-side pipe element 16 corresponds to the second pipe element. As illustrated in FIG. 2, which will be described later, a first end portion (left end portion in FIG. 2) of the P-side pipe element 16 as viewed in the axial direction is fitted into the second end portion (right end portion in FIG. 2) of the D-side pipe element 14 as viewed in the axial direction, and they are swaged and fixed together along with the cowl brace 26 by electromagnetic forming. In the illustrated embodiment, the length of the D-side pipe element 14 is shorter than the length of the P-side pipe element 16. The D-side pipe element 14 has an outer diameter and an inner diameter greater than those of the P-side pipe element 16 in portions other than where the D-side pipe element 14 and the P-side pipe element 16 are fitted to each other.

The D-side extension 20 is fixed to the outside of an end portion of the pipe member 12 located on the first side, which is the driver side. The P-side extension 27 is fixed to the outside of an end portion of the pipe member 12 located on the second side, which is the passenger side. The D-side and P-side extensions 20 and 27 are fixed to a vehicle body frame (not illustrated) by nuts and bolts or other fastening members. The D-side outer bracket 28 is fixed to the outside of the pipe member 12 so as to be adjacent to the D-side extension 20 on the second side as viewed in the axial direction. The P-side outer bracket 29 is fixed to the outside of the pipe member 12 so as to be adjacent to the P-side extension 27 on the first side as viewed in the axial direction.

The steering support 22 is fixed to the outside of an intermediate portion of the D-side pipe element 14 as viewed in the axial direction. Referring back to FIG. 1, the steering support 22 includes a main portion 23 and two legs 24 and 25 joined to the main portion 23 in a branched manner, and the legs 24 and 25 are fixed to the D-side pipe element 14. A steering column (not illustrated) for supporting a steering shaft is fixed to the steering support 22.

The cowl brace 26 is joined to a member (not illustrated) placed inside the instrument panel.

The pipe assembly 10 is formed by fixing the plurality of additional fixture members such as the D-side extension 20 and the steering support 22 to the outside of the pipe member 12 by electromagnetic forming. In this configuration, in a comparative example method, the pipe member 12 may be swaged each time one of the additional fixture members is to be fixed to the pipe member 12, by placing an electromagnetic coil inside the pipe member 12 at the position where the additional fixture member is to be fixed and applying a pulse current to the electromagnetic coil. This method is repeated each time one of the additional fixture members is to be fixed. However, because this method requires a long time for manufacturing the pipe assembly, the costs for manufacturing the pipe assembly may be increased.

In another comparative example method, as described above preceding the SUMMARY section of the present disclosure, the plurality of additional fixture members may be fixed to the pipe member by simultaneous electromagnetic forming in order to shorten the manufacturing time of the pipe assembly. However, in this method, even if a current is intended to be simultaneously applied to the plurality of electromagnetic coils, a slight time lag may occur in an actual process between times at which a current is applied to a plurality of portions that are to be swaged. As such, the resulting order in which a current is applied may cause a failure to form the pipe assembly into a desired shape. The method of manufacturing a pipe assembly according to the illustrated embodiment is directed toward addressing these issues.

Figure 3:
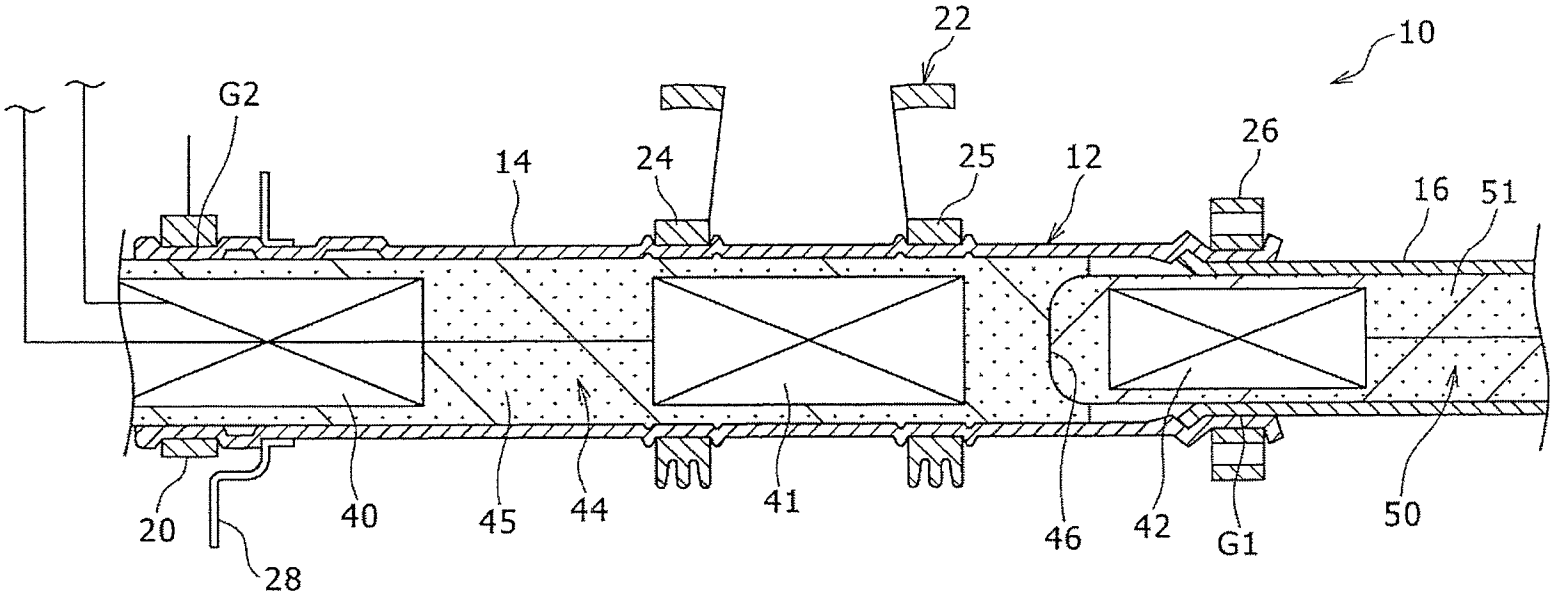
FIG. 3 is an enlarged view of the left half of FIG. 2.

A method of manufacturing the pipe assembly 10 will be described below with reference to FIGS. 2 and 3. FIG. 2 is a cross section A-A in FIG. 1 that illustrates the method of manufacturing the pipe assembly 10. FIG. 3 is an enlarged view of the left half of FIG. 2.

A manufacturing device 38 for the pipe assembly 10 includes four electromagnetic coils, that is, two first electromagnetic coils 40 and 41 and two second electromagnetic coils 42 and 43. Specifically, the manufacturing device 38 includes a first shaft member 44 that is inserted from the first end of the pipe member 12, as viewed in the axial direction, toward the inside, a second shaft member 50 that is inserted from the second end of the pipe member 12, as viewed in the axial direction, toward the inside, and a power supply device 60. The first shaft member 44 has a shape like a long cylindrical shaft that is formed by a resin 45 and includes the first electromagnetic coils 40 and 41 embedded in the resin 45 in the inside at two positions that are apart from each other as viewed in the axial direction. The second shaft member 50 has a shape like a long cylindrical shaft that is formed by a resin 51 and includes the second electromagnetic coils 42 and 43 embedded in the resin 51 in the inside at two positions that are apart from each other as viewed in the axial direction.

The first shaft member 44 is placed inside the D-side pipe element 14, and the second shaft member 50 is placed inside the P-side pipe element 16. The first shaft member 44 is shorter than the second shaft member 50 in accordance with the relationship between the lengths of the D-side pipe element 14 and the P-side pipe element 16. Also, the outer diameter of the first shaft member 44 is greater than the outer diameter of the second shaft member 50 in accordance with the feature that the inner diameter of the D-side pipe element 14 is greater than the inner diameter of the P-side pipe element 16.

The first shaft member 44 includes a recess 46 in a central portion of the second end surface (right end surface in FIGS. 2 and 3) as viewed in the axial direction. The second shaft member 50 is inserted in the recess 46, and the first end surface (left end surface in FIGS. 2 and 3) of the second shaft member 50 as viewed in the axial direction is brought into abutment with the recess 46. The second shaft member 50 has a beveled surface having a rounded cross section on the outer circumferential portion of the first end surface as viewed in the axial direction. The recess 46 correspondingly has a beveled surface having a rounded cross section at the junction between the bottom surface and the inner circumferential surface. As such, when the first shaft member 44 and the second shaft member 50 are brought into abutment with each other, the axes of the shaft members 44 and 50 easily match with each other, as it is less likely that the beveled surface of the second shaft member 50 will get caught by the open end of the recess on the second end surface of the first shaft member 44.

In FIGS. 2 and 3, the outer diameters of the first shaft member 44 and the second shaft member 50 are substantially the same as the inner diameters of the D-side pipe element 14 and the P-side pipe element 16, respectively, by way of illustration. However, in an actual configuration, a clearance is formed in the diameter direction between the first shaft member 44 and the D-side pipe element 14, and between the second shaft member 50 and the P-side pipe element 16 so that the shaft members 44 and 50 can move smoothly in the axial direction inside a corresponding one of the pipe elements 14 and 16. The same also applies to the structure illustrated in FIGS. 4 and 5, which will be described later.

As described above, the first end surface of the second shaft member 50 as viewed in the axial direction is brought into abutment with the recess 46 of the first shaft member 44. One of the two first electromagnetic coils 40 and 41, the electromagnetic coil 40 here, is fixed to the first shaft member 44 so as to be located inside the D-side pipe element 14 in the above-described state at the positions where the D-side extension 20 and the D-side outer bracket 28 are to be fixed. Another one of the two first electromagnetic coils 40 and 41, the electromagnetic coil 41 here, is fixed to the first shaft member 44 so as to be located inside the D-side pipe element 14 in the above-described state at the positions where the legs 24 and 25 of the steering support 22 are to be fixed.

One of the two second electromagnetic coils 42 and 43, the second electromagnetic coil 42 here, is fixed to the second shaft member 50 so as to be located inside the P-side pipe element 16 in the above-described state at the position where the cowl brace 26 is to be fixed. Another one of the two second electromagnetic coils 42 and 43, the second electromagnetic coil 43 here, is fixed to the second shaft member 50 so as to be located inside the P-side pipe element 16 in the above-described state at the positions where the P-side extension 27 and the P-side outer bracket 29 are to be fixed.

The power supply device 60 (FIG. 2) includes a first power supply unit 61, a second power supply unit 62, a controller 63, and four discharge switches 64, 65, 66, and 67. The first power supply unit 61 is configured to supply power to the first electromagnetic coils 40 and 41, and includes a direct-current high-voltage power supply such as a battery, a charge switch, and a capacitor. The first power supply unit 61 is connected to the two first electromagnetic coils 40 and 41 via the two discharge switches 64 and 65. By turning the discharge switches 64 and 65 off and turning the charge switch on, a large amount of charge coming from the direct-current high-voltage power supply is accumulated at the capacitor so that the capacitor is charged. By turning the charge switch off and turning one of the discharge switches 64 and 65 on, a large pulse current is output from the capacitor to a corresponding one of the first electromagnetic coils 40 and 41. The direct-current high-voltage power supply may also include an AC/DC converter that converts alternating-current power supplied from a commercial alternating-current power source into a direct current.

The second power supply unit 62 is configured to supply power to the second electromagnetic coils 42 and 43, and has features and functions that are similar to those of the first power supply unit 61. The second power supply unit 62 is connected to the two second electromagnetic coils 42 and 43 via the two discharge switches 66 and 67.

The controller 63 controls the charge switches of the power supply units 61 and 62 and the discharge switches 64, 65, 66, and 67. The controller 63 is suitably composed of a microcomputer including, for example, a processor, a storage unit such as a memory, and an I/O interface. The controller 63 reads, for example, a program and data stored in the storage unit, and performs a predetermined operation. The controller 63 executes the program to thereby control the operation of the discharge switches 64, 65, 66, and 67 and the charge switches so that a pulse current is applied to the electromagnetic coils 40, 41, 42, and 43 in preset order, as will be described later.

The processor may be any type of processor that can achieve a function by executing a program. The processor is composed of one or more electronic circuits. The electronic circuits may be integrated on a single chip or may be implemented on a plurality of chips.

In an embodiment, the method of manufacturing a pipe assembly includes a placement step and an electromagnetic forming step. In the placement step, a plurality of additional fixture members are placed outside the pipe member 12 at a plurality of positions of the pipe member 12 as viewed in the axial direction where the plurality of additional fixture members are to be fixed. The plurality of additional fixture members are the steering support 22, the D-side and P-side extensions 20 and 27, the two outer brackets 28 and 29, and the cowl brace 26. In this configuration, the D-side pipe element 14 and the P-side pipe element 16 included in the pipe member 12 have a cylindrical shape, and the first end portion of the P-side pipe element 16 is fitted inside the second end portion of the D-side pipe element 14.

The extensions 20 and 27, the outer brackets 28 and 29, the steering support 22, and the cowl brace 26 are fixed by means of jigs (not illustrated). Each of the extensions 20 and 27, the outer brackets 28 and 29, the steering support 22, and the cowl brace 26 has a through hole having a circular shape. The D-side pipe element 14 is fitted inside the through holes of the D-side extension 20, the D-side outer bracket 28, the steering support 22, and the cowl brace 26 with a clearance between them. The portion where the D-side pipe element 14 and the P-side pipe element 16 are fitted to each other is placed inside the through hole of the cowl brace 26. The D-side pipe element 14 and the P-side pipe element 16 are supported by means of the jigs (not illustrated) via the additional fixture members. The D-side pipe element 14 and the P-side pipe element 16 may be supported by a guide member (not illustrated) so as to be slidable in the axial direction in order to prevent the axes of the D-side pipe element 14 and the P-side pipe element 16 from deviating from each other in the radial direction. This configuration is more preferable in terms of enhancing the shape accuracy of the pipe assembly 10. The second end portion (right end portion in FIG. 2) of the P-side pipe element 16 is fitted inside the through holes of the P-side extension 27 and the P-side outer bracket 29 with a clearance between them.

Additionally, in the placement step, the electromagnetic coils 40, 41, 42, and 43 are each placed inside the pipe member 12 at one or more of the plurality of positions of the pipe member 12 where the plurality of additional fixture members are to be fixed. In this configuration, the first shaft member 44, which includes the first electromagnetic coils 40 and 41, is placed inside the pipe member 12 so as to be movable in the axial direction by means of two guide rollers 70 (see FIG. 5) located on the first side, which are guides placed outside the pipe member 12. The second shaft member 50, which includes the second electromagnetic coils 42 and 43, is placed inside the pipe member 12 so as to be movable in the axial direction by means of guide rollers 71 (see FIG. 5) located on the second side, which are placed outside the pipe member 12. The first shaft member 44 is inserted from the first end of the pipe member 12, as viewed in the axial direction, toward the inside, and the second shaft member 50 is inserted from the second end of the pipe member 12, as viewed in the axial direction, toward the inside. During the time when the shaft members 44 and 50 are inserted into the pipe member 12, the capacitors of the power supply units 61 and 62 may be charged. The manufacturing time can therefore be shortened. The first shaft member 44 and the second shaft member 50 are then brought into abutment with each other as viewed in the axial direction. In the above-described state, one of the two first electromagnetic coils 40 and 41, the first electromagnetic coil 40 here, is placed in the inside at the positions where the D-side extension 20 and the outer bracket 28 are to be fixed. Another one of the two first electromagnetic coils, the first electromagnetic coil 41 here, is placed in the inside at the positions where the legs 24 and 25 of the steering support 22 are to be fixed. One of the two second electromagnetic coils 42 and 43, the second electromagnetic coil 42 here, is placed in the inside at the position where the cowl brace 26 is to be fixed. Another one of the two first electromagnetic coils, the second electromagnetic coil 43 here, is placed in the inside at the positions where the P-side extension 27 and the outer bracket 29 are to be fixed.

Subsequently, in the electromagnetic forming step, a pulse current is applied to the electromagnetic coils 40, 41, 42, and 43 in preset order. In this configuration, the storage unit of the controller 63 stores the order. The controller 63 switches the discharge switches 64, 65, 66, and 67 and the charge switches on or off so that a current is applied to the electromagnetic coils 40, 41, 42, and 43 in accordance with that order.

Referring to FIG. 2, the order in which a current is applied to the electromagnetic coils 40, 41, 42, and 43 is denoted by the circled figures in the electromagnetic coils 40, 41, 42, and 43. More specifically, a pulse current is applied to the second electromagnetic coil 42 placed inside the cowl brace 26, and after that, a pulse current is applied to the first electromagnetic coil 41 placed inside the steering support 22. Subsequently, a pulse current is applied to the second electromagnetic coil 43 placed inside the P-side extension 27 and the outer bracket 29, and then to the first electromagnetic coil 40 placed inside the D-side extension 20 and the outer bracket 28. Each time after the application of a pulse current to the electromagnetic coil 40, 41, 42, or 43 ends, the capacitor is charged from the direct-current high-voltage power supply in the corresponding one of the power supply units 61 and 62.

The diameter of the pipe member 12 is increased in areas corresponding to where the electromagnetic coils 40, 41, 42, and 43 are placed, as viewed in the axial direction, in this manner so that the plurality of additional fixture members are swaged and fixed to the pipe member 12 by electromagnetic forming.

In this configuration, a plurality of joints between the pipe member 12 and the plurality of additional fixture members at the plurality of positions where the plurality of additional fixture members are to be fixed include a first joint G1 and second joints G2 and G3. The first joint G1 is a joint joining the cowl brace 26 to the pipe member 12 where the cowl brace 26 is joined to the outside of the portion where the D-side pipe element 14 and the P-side pipe element 16 are fitted to each other. The second joint G2 is a joint joining the D-side extension 20 and the outer bracket 28 to the pipe member 12. The second joint G3 is a joint joining the P-side extension 27 and the outer bracket 29 to the pipe member 12. The second joints G2 and G3 are two joints where additional fixture members are joined to each of the D-side pipe element 14 and the P-side pipe element 16 at positions other than where the D-side pipe element 14 and the P-side pipe element 16 are fitted to each other. The assembly tolerance of the first joint G1 tends to be stricter than those of the second joints G2 and G3. In other words, the absolute value of the assembly tolerance for the first joint G1 tends to be smaller than those for the second joints G2 and G3. The reason for this is that, at the first joint G1, two pipe elements, the D-side pipe element 14 and the P-side pipe element 16, are to be deformed by electromagnetic forming and the deformed portion of the D-side pipe element 14 that is located outside is to be swaged to both ends of the cowl brace 26 as viewed in the axial direction. At the second joints G2 and G3, both the two pipe elements do not have to be deformed. Therefore, the required assembly accuracy tends to be higher at the first joint G1 than at the second joints G2 and G3 so as to strictly regulate the fitting and swaging amount (wrapped amount). For example, C1 is smaller than C2 where C1 represents the absolute value of the assembly tolerance of the first joint G1, and C2 represents the absolute value of the assembly tolerance of the second joint G2.

In the illustrated embodiment, the diameter of the pipe member is increased at a plurality of positions of the pipe member by applying a current to the electromagnetic coils in a state in which the plurality of electromagnetic coils 40, 41, 42, and 43 are placed inside the pipe member 12, so that the plurality of additional fixture members are swaged and fixed to the pipe member 12. The manufacturing time of the pipe assembly 10 can therefore be shortened. A pulse current is applied to the plurality of electromagnetic coils in a manner such that the cowl brace 26 that constitutes the first joint G1 is swaged and fixed to the pipe member 12 by electromagnetic forming before the extensions 20 and 27 and the outer brackets 28 and 29 that constitute the second joints G2 and G3. As the portion of the pipe member 12 that forms the first joint G1 is therefore worked on before the portions of the pipe member 12 that form the second joints G2 and G3, the assembly accuracy of the first joint G1 is easily maintained at a high level. The required assembly accuracy tends to be higher at the first joint G1 than at the second joints G2 and G3. Therefore, even if deformation of the portions of the pipe member 12 that four the second joints G2 and G3 is caused by deformation of the portion of the pipe member 12 that forms the first joint G1, the impaired deformation accuracy is easily absorbed at the second joints G2 and G3. The order in which a current is applied to the plurality of electromagnetic coils can therefore be set as appropriate so as to enhance the shape accuracy of the pipe assembly 10, so that the pipe assembly 10 can be manufactured into a desired shape while the manufacturing time of the pipe assembly 10 is shortened.

Only the D-side extension 20, the cowl brace 26, the D-side outer bracket 28, and the steering support 22 serving as the plurality of additional fixture members are swaged and fixed to the D-side pipe element 14 by electromagnetic forming. Among the plurality of additional fixture members that are fixed to the D-side pipe element 14, the D-side extension 20 and the cowl brace 26 are placed at positions each closest to one of the ends of the D-side pipe element 14. The D-side extension 20 and the cowl brace 26 correspond to the two end side additional fixture members. The D-side outer bracket 28 and the steering support 22 correspond to the two intermediate additional fixture members. The D-side extension 20, the cowl brace 26, the D-side outer bracket 28, and the steering support 22 are fixed to jigs in a manner such that they are fitted to the D-side pipe element 14 with a clearance between them. In the above-described state, the D-side extension 20, which is one of the D-side extension 20 and the cowl brace 26 that is fixed to the D-side pipe element 14 later than the other, is swaged and fixed to the D-side pipe element 14 by electromagnetic forming after the steering support 22 and simultaneously with the D-side outer bracket 28. A pulse current is applied to the plurality of first and second electromagnetic coils 40, 41, 42, and 43 under the above-described conditions.

The shape accuracy of the pipe assembly 10 is therefore easily enhanced. More specifically, the pipe assembly 10 is manufactured by the method described below. In the following description, arrows indicate temporal sequence. A plurality of additional fixture members are fixed by means of jigs. -->> The D-side and P-side pipe elements 14 and 16 are inserted through the plurality of additional fixture members in a state in which the first end portion of the P-side pipe element 16 is fitted into the second end portion of the D-side pipe element 14. -->> The cowl brace 26, which is one of the two end side additional fixture members that is fixed earlier than the other, is swaged and fixed to the D-side pipe element 14. -->> The steering support 22, which is an intermediate additional fixture member, is swaged and fixed to the D-side pipe element 14. -->> The D-side outer bracket 28, which is another intermediate additional fixture member, and the D-side extension 20, which is one of the two end side additional fixture members that is fixed later than the other, are simultaneously swaged and fixed to the D-side pipe element 14. -->> The plurality of additional fixture members are removed from the jigs. The D-side extension 20, which is one of the D-side extension 20 and the cowl brace 26 that is fixed to the D-side pipe element 14 later than the other, is therefore swaged and fixed to the D-side pipe element 14 by electromagnetic forming after the steering support 22 and simultaneously with the D-side outer bracket 28. The D-side pipe element 14 is not fixed to any jig before the additional fixture members are swaged and fixed to the D-side pipe element 14. Therefore, the end portion of the D-side pipe element 14 that is closer to the D-side extension 20 is not fixed to any jig when the D-side outer bracket 28 and the steering support 22 are swaged and fixed to the D-side pipe element 14. Therefore, deformation (shrinkage) of the D-side pipe element 14 in the axial direction is allowed so as to relieve stress produced in the D-side pipe element 14 by swaging. For example, as a portion of the D-side pipe element 14 is expanded so as to reduce the thickness when the steering support 22 is swaged and fixed to the D-side pipe element 14, the length as viewed in the axial direction tends to shrink by the amount by which the length of the expanded portion in the circumferential direction increases in a manner such that an amount of material is gathered from both sides of the expanded portion. In this configuration, because the end portion of the D-side pipe element 14 that is closer to the D-side extension 20 is allowed to slide inside the D-side extension 20 to be deformed and get closer to the expanded portion, stress produced in the D-side pipe element 14 by swaging can be relieved. Therefore, the D-side pipe element 14 does not come into an elastically pulled state between the plurality of positions where the plurality of additional fixture members fixed to the jigs are fixed. Therefore, it is possible to prevent deformation (shrinkage) of the D-side pipe element 14 in the axial direction from occurring as the tensile strength acting on the D-side pipe element 14 is removed in a state in which the D-side extension 20 and the cowl brace 26 are fixed to the D-side pipe element 14 when the additional fixture members are later removed from the jigs. As a result, because the length of the D-side pipe element 14 between the D-side extension 20 and the cowl brace 26 is easily adjusted to a desired value, the shape accuracy of the pipe assembly 10 is easily enhanced.

When the steering support 22 is swaged and fixed to the D-side pipe element 14, the D-side pipe element 14 is deformed to become shorter as a swaged portion of the D-side pipe element 14 is formed. In this state, because the D-side extension 20 is not fixed to the D-side pipe element 14, the D-side pipe element 14 is allowed to shift in the axial direction with respect to the through hole of the D-side extension 20. The D-side pipe element 14 therefore becomes shorter by electromagnetic forming. To allow for this reduction in length, the D-side pipe element 14 may be formed to be longer beforehand. Alternatively, the D-side extension 20 may be swaged and fixed to the D-side pipe element 14 by electromagnetic forming after the D-side outer bracket 28.

On the other hand, in contrast to the above-described embodiment, one of the D-side outer bracket 28 and the steering support 22 may be swaged and fixed to the D-side pipe element 14 by electromagnetic forming after the D-side extension 20, which is one of the D-side extension 20 and the cowl brace 26 that is fixed to the D-side pipe element 14 later than the other. In this case, after the D-side extension 20 and the cowl brace 26 are both fixed to the D-side pipe element 14, the D-side pipe element 14 is in a state in which the end portions on both sides of the D-side pipe element 14 are fixed to the jigs via the D-side extension 20 and the cowl brace 26. Stress produced when one of the D-side outer bracket 28 and the steering support 22 is later swaged and fixed to the D-side pipe element 14 therefore cannot be relieved. In this configuration, the D-side pipe element 14 is in an elastically pulled state between the positions where the D-side extension 20 and the cowl brace 26 are fixed. Therefore, the D-side pipe element 14 may deform to shrink so as to relieve that stress when the additional fixture members are removed from the jigs, such that the length between the D-side extension 20 and the cowl brace 26 becomes shorter. As the illustrated embodiment can address this issue, the shape accuracy of the pipe assembly 10 is easily further enhanced.

In the placement step, the first shaft member 44 and the second shaft member 50 are inserted from both ends of the pipe member 12 as viewed in the axial direction toward the inside, and a pulse current is applied to the electromagnetic coils 40, 41, 42, and 43 while the first shaft member 44 and the second shaft member 50 are held in abutment with each other in the axial direction. The plurality of additional fixture members are swaged and fixed to the pipe member 12 by electromagnetic forming in this manner. As such, electromagnetic forming may be performed by simply inserting the first shaft member 44 and the second shaft member 50, which are relatively short, into the pipe member 12, and the electromagnetic coils 40, 41, 42, and 43 are easily placed in the pipe member 12.

In the electromagnetic forming step, a pulse current is alternately applied to the second electromagnetic coils 42 and 43, which are placed in the second shaft member 50, and the first electromagnetic coils 40 and 41, which are placed in the first shaft member 44. In this configuration, a current is applied to the first electromagnetic coils 40 and 41 and the second electromagnetic coils 42 and 43 from different power supply units, that is, from the first power supply unit 61 and from the second power supply unit 62, respectively. The entire time length from the start of initial application of a current to an electromagnetic coil until the completion of final application of a current to an electromagnetic coil can be shortened in this manner, while the period of time in which a capacitor is charged by turning the charge switch on after discharge from the power supply unit 61 or 62 until, after that, discharge from the same power supply unit starts again, is made longer. As sufficient charging time can be ensured in this manner, a large power pulse current can be applied, and the manufacturing time can be shortened.

Figure 4:
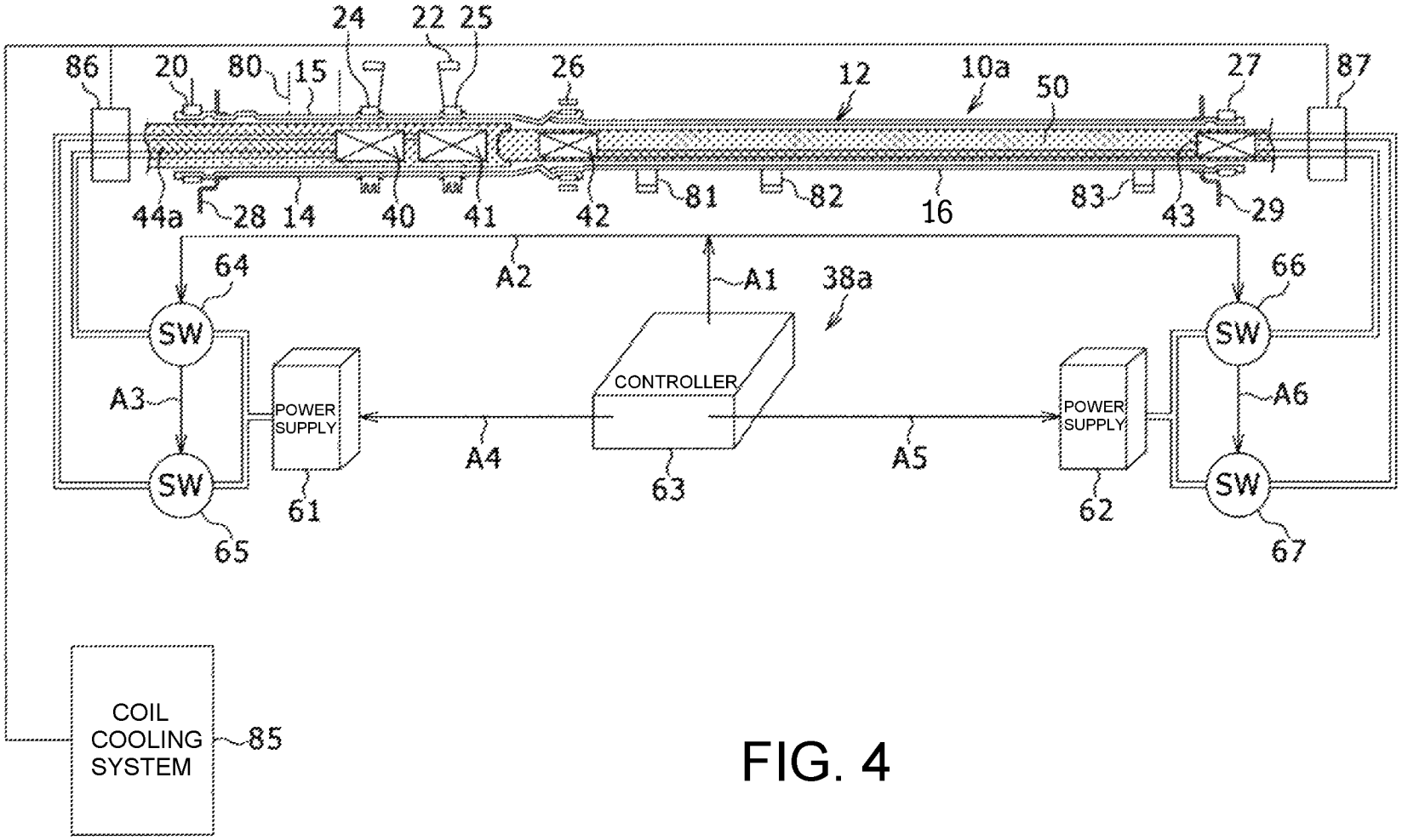
FIG. 4 illustrates a method of manufacturing a pipe assembly according to a second embodiment of the present disclosure.
Figure 5:
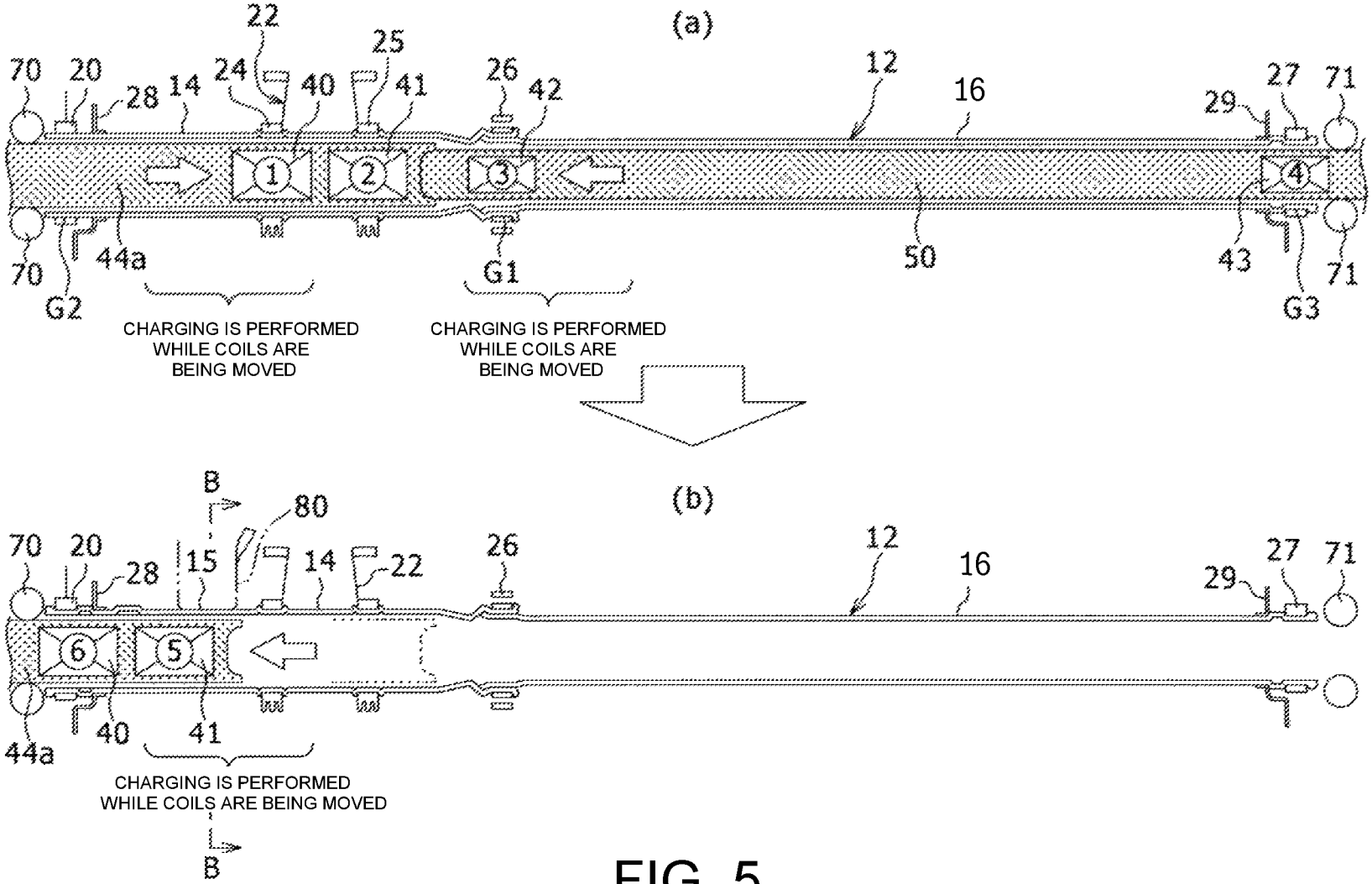
FIG. 5 illustrates two states of the second embodiment of the present disclosure: a first step of electromagnetic forming is performed in state (a), and a second step of electromagnetic forming is performed in state (b)

FIG. 4 illustrates a method of manufacturing a pipe assembly according to a second embodiment. FIG. 5 illustrates two states of the second embodiment. That is, a first step of electromagnetic forming is performed in state (a), and a second step of electromagnetic forming is performed in state (b).

In the structure illustrated in FIG. 4, a D-side intermediate bracket 80 and a plurality of P-side intermediate brackets 81, 82, and 83 are fixed by welding to the outside of the pipe member 12 in part in the circumferential direction of the pipe member 12. The D-side intermediate bracket 80 is fixed to a flat portion 15 that is formed in an intermediate portion of the D-side pipe element 14 as viewed in the axial direction in part in the circumferential direction. For this purpose, the intermediate portion of the D-side pipe element 14 as viewed in the axial direction is flattened by electromagnetic forming, as will be described later.

A manufacturing device 38*a* includes an axial movement unit that causes a first shaft member 44*a* and the second shaft member 50 to move in the axial direction, and the controller 63 also controls the driving of the axial movement unit. For example, the axial movement unit includes two guide rollers 70 and two guide rollers 71 that are placed with the shaft member 44*a* or 50 vertically interposed between them, and a motor (not illustrated) that causes an upper or lower one of the two guide rollers 70 or 71 to rotate. In this configuration, as the motor is driven, one of the guide rollers rotates, and the corresponding shaft member moves. As the shaft member moves, another one of the two guide rollers also rotates.

The manufacturing device 38*a* further includes a coil cooling system 85. The coil cooling system 85 causes the first shaft member 44*a* and the second shaft member 50 to pass in contact with two coolers 86 and 87, respectively, to which a coolant such as cooling oil or cooling water is supplied. The coolers 86 and 87 may be, for example, containers that are formed by a high heat transfer material. With this structure, as the electromagnetic coils fixed in the shaft members 44*a* and 50 can be cooled down, good performance of the electromagnetic coils is easily maintained. This coil cooling system 85 can also be used in the above-described embodiment illustrated in FIGS. 1 to 3.

Further, the first shaft member 44*a* includes two first electromagnetic coils 40 and 41 that are placed only in a portion located closer to the second end as viewed in the axial direction (a portion located closer to the right end in FIG. 4). The two first electromagnetic coils 40 and 41 are connected to the first power supply unit 61 via the discharge switches 64 and 65, respectively.

Arrows A1, A2 . . . and A6 in FIG. 4 indicate that the controller 63 controls the power supply units 61 and 62 and the discharge switches 64, 65, 66, and 67. The arrows A3 and A6 indicate the order in which the discharge switches 64, 65, 66, and 67 are turned on during electromagnetic forming. More specifically, the discharge switch 65 is turned on after the discharge switch 64, and the discharge switch 67 is turned on after the discharge switch 66.

In the method of manufacturing a pipe assembly according to the illustrated embodiment, in the placement step, the first shaft member 44*a* and the second shaft member 50 are inserted from both ends of the pipe member 12 as viewed in the axial direction toward the inside, and an end surface of the second shaft member 50 as viewed in the axial direction and an end surface of the first shaft member 44*a* as viewed in the axial direction are brought into abutment with each other. During the time when the shaft members 44*a* and 50 are inserted into the pipe member 12, the capacitors of the power supply units 61 and 62 may be charged. In the above-described state, the second end (right end in FIG. 4) of the first shaft member 44*a* as viewed in the axial direction is positioned at a first predetermined position. At this time, the two first electromagnetic coils 40 and 41 of the first shaft member 44*a* are placed inside the positions where the two legs 24 and 25 of the steering support 22 are to be fixed. The two second electromagnetic coils 42 and 43 are placed inside the position where the cowl brace 26 is to be fixed and inside the positions where the P-side extension 27 and the outer bracket 29 are to be fixed. This placement arrangement of the electromagnetic coils is the same as that illustrated in FIG. 5(*a*).

In the electromagnetic forming step, a first step of electromagnetic forming is performed in the above-described state as illustrated in FIG. 5(*a*). In the first step of electromagnetic forming, after a pulse current is applied to one of the two first electromagnetic coils 40 and 41, the first electromagnetic coil 40 here, the capacitor of the first power supply unit 61 is charged, and after that, a pulse current is applied to another one of the two, the first electromagnetic coil 41 here. Referring to FIG. 5, the order in which a pulse current is applied is denoted by the circled figures in the electromagnetic coils 40, 41, 42, and 43. The two legs 24 and 25 of the steering support 22 are swaged and fixed to the D-side pipe element 14 by electromagnetic forming in this manner. The order in which a current is applied to the two first electromagnetic coils 40 and 41 may be the opposite. As the two legs 24 and 25 are temporally separately swaged and fixed to the D-side pipe element 14, large power is easily supplied to the first electromagnetic coils 40 and 41 that are placed inside the legs 24 and 25. Therefore, the legs 24 and 25 are easily swaged and fixed.

Subsequently, after a pulse current is applied to one of the two second electromagnetic coils 42 and 43, the second electromagnetic coil 42 here, the capacitor of the second power supply unit 62 is charged, and after that, a pulse current is applied to another one of the two, the second electromagnetic coil 43 here. As such, after the cowl brace 26 is swaged and fixed to the portion where the D-side and P-side pipe elements 14 and 16 are fitted to each other, the P-side outer bracket 29 and the extension 27 are swaged and fixed to the second end portion (right end portion in FIG. 5(*a*)) of the P-side pipe element 16. Similarly to the embodiment illustrated in FIGS. 1 to 3, the cowl brace 26 that constitutes the first joint G1 is therefore swaged and fixed to the pipe member 12 before the P-side extension 27 that constitutes the second joint G3 and the D-side extension 20 that constitutes the second joint G2, which will be described later. The required assembly accuracy tends to be higher at the first joint G1 than at the second joints G2 and G3. The pipe assembly 10 can therefore be manufactured into a desired shape.

As illustrated in FIG. 5(*b*), the first shaft member 44*a* is moved in the axial direction inside the pipe member 12 in a direction in which it is drawn out from the first end (left end in FIG. 5(*b*)) of the pipe member 12 toward the outside either simultaneously with or after application of a current to the second electromagnetic coils 42 and 43. The capacitor of the first power supply unit 61 is charged while the first shaft member 44*a* is being moved. The movement of the first shaft member 44*a* is stopped in a state in which the second end (right end in FIG. 5(*b*)) of the first shaft member 44*a* as viewed in the axial direction is positioned at a second predetermined position. In this state, the two first electromagnetic coils 40 and 41 of the first shaft member 44*a* are placed inside the portion of the D-side pipe element 14 that is to be flattened and inside the positions where the D-side outer bracket 28 and the extension 20 are to be fixed. At this time, the D-side outer bracket 28 and the extension 20 are located on the D-side pipe element 14 outside one of the two first electromagnetic coils 40 and 41, the first electromagnetic coil 40 here. Referring to FIG. 5(*b*), the second shaft member 50 has been drawn out from the second end (right end in FIG. 5(*b*)) of the pipe member 12 as viewed in the axial direction. However, the second shaft member 50 may remain inside the pipe member 12.

In the above-described state, as the second step of electromagnetic forming, a pulse current is applied to another one of the two first electromagnetic coils 40 and 41, the first electromagnetic coil 41 here, so that the flat portion 15 is formed on the D-side pipe element 14. In this configuration, a flattening jig 90 (FIG. 6) is placed beforehand around the D-side pipe element 14 in the portion where the flat portion 15 is to be formed.

Figure 6:
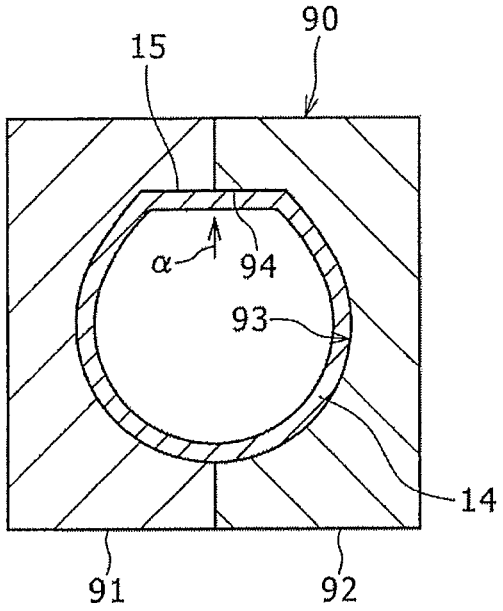
FIG. 6 illustrates a view corresponding to a cross section B-B in FIG. 5(*b*), in which a flat portion is formed in a portion of the pipe member using a flattening jig in the second step of electromagnetic forming according to the second embodiment of the present disclosure.

FIG. 6 illustrates a view corresponding to a cross section B-B in FIG. 5(*b*), in which the flat portion 15 is formed in a portion of the pipe member 12 using the flattening jig 90 in the second step of electromagnetic forming. As illustrated in FIG. 6, the flattening jig 90 is formed to have a noncircular hole 93 in the inside by abutting two elements 91 and 92 together, each of the two elements 91 and 92 including a recess having a substantially semicircular cross section on one side, so that the recesses face each other. The hole 93 has a shape including a flat portion 94 in part in the circumferential direction, in which the flat portion 94 and a portion having a substantially circular cross section are joined together. The outer circumferential surface of the D-side pipe element 14 that has yet to be subjected to electromagnetic forming is substantially in contact with the substantially circular portion of the hole 93. While the intermediate portion of the D-side pipe element 14 as viewed in the axial direction is covered by the flattening jig 90, a pulse current is then applied to the first electromagnetic coil 41 (FIG. 5(*b*)). The diameter of a portion of the intermediate portion of the D-side pipe element 14 as viewed in the axial direction that is opposed to the flat portion 94 of the flattening jig 90 is increased in this manner, so that the flat portion 15 is formed in this intermediate portion as viewed in the axial direction. At this time, the D-side pipe element 14 is deformed such that the diameter is increased toward arrow a in FIG. 6. In a later process, the D-side intermediate bracket 80 is fixed by welding to the flat portion 15, as described above.

Subsequently, a pulse current is applied to one of the two first electromagnetic coils 40 and 41, the first electromagnetic coil 40 here, so that the D-side outer bracket 28 and the extension 20 that constitute the second joint G2 are swaged and fixed to the first end portion of the D-side pipe element 14 by electromagnetic forming.

By employing the above-described structure, a pulse current is applied to the first electromagnetic coils 40 and 41 while the first shaft member 44*a* is positioned at the first position, and after that, the first shaft member 44*a* is moved in the axial direction, and a pulse current is applied to the first electromagnetic coils 40 and 41 while the first shaft member 44*a* is positioned at the second position. As the first shaft member 44*a* is moved in this manner, different members, that is, the steering support 22 and the D-side outer bracket 28 and the extension 20, can be swaged and fixed by the same first electromagnetic coils 40 and 41. Therefore, the number of electromagnetic coils required for electromagnetic forming can be reduced.

In the present embodiment, in contrast to the embodiment illustrated in FIG. 2, the cowl brace 26 is swaged and fixed to the pipe member 12 after the steering support 22. As such, after the steering support 22 is swaged and fixed to the pipe member 12 using the first electromagnetic coils 40 and 41 of the first shaft member 44*a*, the cowl brace 26 can be swaged and fixed to the pipe member 12 using the second electromagnetic coil 42 of the second shaft member 50 during the time when the first shaft member 44*a* is being moved.

In the present embodiment, the intermediate portion of the D-side pipe element 14 as viewed in the axial direction is subjected to flattening by electromagnetic forming. The electromagnetic forming for flattening is performed before the D-side extension 20, which is one of the cowl brace 26 and the D-side extension 20 fixed to both ends of the D-side pipe element 14, that is fixed to the D-side pipe element 14 later than the other. As such, because the end portion of the D-side pipe element 14 that is closer to the D-side extension 20 is not fixed to any jig when the D-side pipe element 14 is subjected to flattening, stress produced in the D-side pipe element 14 by flattening can be relieved. Therefore, because it is possible to prevent deformation of the D-side pipe element 14 in the axial direction from occurring when the additional fixture members are later removed from the jigs, the shape accuracy of the pipe assembly 10 is easily enhanced. In the present embodiment, the remaining features and effects are similar to those of the embodiment illustrated in FIGS. 1 to 3.

In the foregoing description, the embodiments in which the pipe member is composed of the D-side and P-side pipe elements are described. However, the present disclosure is not limited to these embodiments. For example, the pipe member may be composed only of a tubular pipe element that includes a D-side pipe element portion and a P-side pipe element portion. In this structure, in the placement step, the plurality of additional fixture members are placed outside the pipe element and fixed to jigs in a manner such that they are fitted to the pipe element with a clearance between them. The plurality of additional fixture members may include a plurality of intermediate additional fixture members and two end side additional fixture members (for example, the D-side and P-side extensions) that are located on both ends. In this configuration, one of the two end side additional fixture members that is fixed to the pipe element later than the other, may preferably be swaged and fixed to the pipe element by electromagnetic forming either after the plurality of intermediate additional fixture members or simultaneously with one of the intermediate additional fixture members. In this preferred structure as well, the shape accuracy of the pipe assembly is easily enhanced in a similar manner to that in the embodiment illustrated in FIGS. 1 to 3.

The invention claimed is:

1. A method of manufacturing a pipe assembly, the pipe assembly including a pipe member and a plurality of additional fixture members that are externally fixed to the pipe member, wherein the pipe member includes a first pipe element and a second pipe element that is fitted and joined to an end portion of the first pipe element, wherein a plurality of joints between the pipe member and the plurality of additional fixture members at a plurality of positions of the pipe member, as viewed in the axial direction, where the plurality of additional fixture members are to be fixed include a first joint, where one of the additional fixture members is joined to the outside of the portion where the first pipe element and the second pipe element are fitted to each other, and one or more second joints, where one or more of the additional fixture members are joined to at least one of the first pipe element and the second pipe element at one or more positions other than where the first pipe element and the second pipe element are fitted to each other, and wherein the method comprises:

placing the plurality of additional fixture members outside the pipe member at the plurality of positions where the plurality of additional fixture members are to be fixed;

placing a plurality of electromagnetic coils inside the pipe member at one or more of the plurality of positions where the plurality of additional fixture members are to be fixed; and while the plurality of additional fixture members are placed outside the pipe member at the plurality of positions where the plurality of additional fixture members are to be fixed and while the plurality of electromagnetic coils are placed inside the pipe member at one or more of the plurality of positions where the plurality of additional fixture members are to be fixed, increasing the diameter of the pipe member in areas corresponding to where the plurality of electromagnetic coils are placed, as viewed in the axial direction, by applying a pulse current to the plurality of electromagnetic coils, so that the plurality of additional fixture members are swaged and fixed to the pipe member by electromagnetic forming, wherein one of the additional fixture members that constitutes the first joint is swaged and fixed to the pipe member by electromagnetic forming before the additional fixture members that constitute the second joints.

2. The method according to claim 1, wherein the first pipe element is a pipe element to which three or more of the plurality of additional fixture members are to be externally fixed, wherein two end side additional fixture members that are placed at positions each closest to one of both ends of the first pipe element and one or more intermediate additional fixture members that are placed between the two end side additional fixture members are swaged and fixed to the first pipe element by electromagnetic forming as the three or more of the plurality of additional fixture members, and wherein, while the three or more of the plurality of additional fixture members are fixed to jigs in a manner such that they are fitted to the first pipe element with a clearance between them, one of the two end side additional fixture members that is fixed to the first pipe element later than the other, is swaged and fixed to the first pipe element by electromagnetic forming either after or simultaneously with the one or more intermediate additional fixture members.

3. A method of manufacturing a pipe assembly, the pipe assembly including a pipe member and a plurality of additional fixture members that are externally fixed to the pipe member, wherein the pipe member includes at least one pipe element to which three or more of the plurality of additional fixture members are to be externally fixed, wherein two end side additional fixture members that are placed at positions each closest to one of two ends of the pipe element and one or more intermediate additional fixture members that are placed between the two end side additional fixture members are swaged and fixed to the pipe element by electromagnetic forming as the three or more of the plurality of additional fixture members, wherein the method comprises:

placing the three or more of the plurality of additional fixture members outside the pipe element at a plurality of positions of the pipe member, as viewed in the axial direction, where the three or more of the plurality of additional fixture members are to be fixed;

placing a plurality of electromagnetic coils inside the pipe element at one or more of the plurality of positions where the three or more of the plurality of additional fixture members are to be fixed; and while the three or more of the plurality of additional fixture members are fixed to jigs in a manner such that they are fitted to the pipe element with a clearance between them, increasing the diameter of the pipe member in areas corresponding to where the plurality of electromagnetic coils are placed, as viewed in the axial direction, by applying a pulse current to the plurality of electromagnetic coils, so that the three or more of the plurality of additional fixture members are swaged and fixed to the pipe member by electromagnetic forming, wherein one of the two end side additional fixture members that is fixed to the pipe element later than the other, is swaged and fixed to the pipe element by electromagnetic forming either after or simultaneously with the one or more intermediate additional fixture members.

* * * * *